United States Patent [19]

Burvee

[11] Patent Number: 4,762,497

[45] Date of Patent: Aug. 9, 1988

[54] ELECTRICAL CONNECTOR FOR ELECTRICALLY CONNECTING THROUGH A FABRIC

[75] Inventor: Richard W. Burvee, Austin, Tex.

[73] Assignee: Minnesota Mining and Manufacturing Company, St. Paul, Minn.

[21] Appl. No.: 29,340

[22] Filed: Mar. 23, 1987

[51] Int. Cl.[4] ..... H01R 3/00

[52] U.S. Cl. ..... 439/37; 439/179

[58] Field of Search ..... 439/37, 92, 178, 179

[56] References Cited

U.S. PATENT DOCUMENTS

| | | | |
|---|---|---|---|
| 1,967,095 | 7/1934 | Mayr | 439/179 |
| 2,673,898 | 3/1954 | Reichert | 439/37 |
| 3,503,034 | 3/1970 | Appleton | 439/179 |
| 3,818,209 | 6/1974 | Roth | 439/37 |
| 4,098,945 | 7/1978 | Oehmke | 428/327 |

FOREIGN PATENT DOCUMENTS

| | | | |
|---|---|---|---|
| 2277451 | 7/1974 | France | 439/178 |

*Primary Examiner*—John McQuade

*Attorney, Agent, or Firm*—Donald M. Sell; John C. Barnes

[57] ABSTRACT

A wrist strap can be connected through the fabric of a cleanroom garment by means of an inexpensive, removable connector comprising two molded plastic parts that can be interconnected to entrap the fabric. Protruding from a reservoir in the first of the two plastic parts is an open tube of open-cell foam which is filled with an electrically conductive gel. The foam tube protrudes from the reservoir and, when the two plastic parts are interconnected, the foam tube is compressed and transmits a squeezing force to the conductive gel, thus forcing a portion of the conductive gel through the exposed open end of the foam tube into the entrapped fabric and against an electrode in the second of the two plastic parts. This completes an electrical connection between that electrode and an electrode in the first plastic part at the base of the reservoir. The conductive gel may also be carried in a collapsible cup which is biased to force the conductive gel through the fabric to complete the electrical connection.

32 Claims, 1 Drawing Sheet

ELECTRICAL CONNECTOR FOR ELECTRICALLY CONNECTING THROUGH A FABRIC

BACKGROUND OF THE INVENTION

The invention concerns an electrical connector that can be fastened to a fabric for electrically connecting through the fabric.

In the manufacture of integrated circuits and other sensitive electronic components, it is customary for persons to wear wrist straps that are electrically connected to ground to guard against the accumulation of electrostatic charges. When such a person is in a clean room, it may be necessary to wear a garment made from a fabric that completely covers the arms and hands. Although the gloves of the garment may be independent of the sleeves, a wire passing from a wrist strap between a glove and sleeve would introduce an opening that could be a source of contamination. When such an opening has been intolerable, an electrical connector has been permanently attached to the sleeve and fastened to wires leading to the wrist strap to the ground. One such permanently attached connector consists of two metal pieces, one having two sharp prongs which are punched through a garment and then bent over to rivet the two pieces together and thus electrically connect them. While the garment is being worn, the internal and exterior wires can pull at such a permanent connector and thus weaken the fabric, eventually producing openings that could be so minute as to be undetectable and yet could pass contaminants. Such a connector can also be subjected to the same sort of stresses by machinery used to clean the garment, typically after each use. Furthermore, the electrical connector can become slightly corroded by the cleaning materials, thus creating an additional possible source of contamination. Even if the metal of a permanent connector is completely resistant to corrosion, contaminants could be entrapped between the connector and the garment fabric during cleaning and might be released when the garment is worn.

SUMMARY OF THE INVENTION

The present invention provides an inexpensive, connector that is useful for electrically connecting through a fabric, which may be removable, and yet avoids the aforementioned problems involving prior connectors. The novel connector can quickly and easily be fastened to the fabric, such as a garment sleeve, and, preferably, removed after each use. It then is separately cleaned with no hazard to the garment.

An electrical connector is provided which is useful for electrically connecting through a fabric. A first part and a second part are adapted to be interconnected to entrap the fabric from both sides. The first part and the second part interconnect to form a reservoir therebetween. A first electrode is coupled to the first part electrically communicating with the interior of the reservoir. A second electrode is coupled to the second part electrically communicating with the interior of the reservoir. A first interconnection mechanism is coupled to the first part for connecting the first electrode exterior of the reservoir on one side of said fabric. A second interconnection mechanism is coupled to the second part for connecting the second electrode exterior of the reservoir on the other side of the fabric. Constructed in this manner the first part and second part may be interconnected from opposite sides of the fabric and the reservoir may be filled with an electrically conductive gel capable of penetrating the fabric and thus an electrical connection be established through the fabric.

For use in a preferred prototype connector of the invention, a tube made of elastic, polymeric foam is formed with a cavity that is open at both ends and is filled with an electrically conductive gel. When the gel-filled open tube is seated in said reservoir, it protrudes beyond the edge of said opening before said first and second parts are interconnected. When the seated tube is compressed by forcing the second electrode against the edge of the reservoir, a squeezing force is transmitted through the foam to the conductive gel, thus forcing a portion of the conductive gel through the exposed open end of the foam tube into the entrapped fabric and against the second electrode.

When used with the above-described gel-filled foam tube, the first electrode of the novel connector should be positioned to be contacted by the conductive gel at the end of the foam tube opposite to the entrapped fabric, so that the conductive gel provides a continuous, electrically conductive path between the two electrodes through the fabric. Preferably the periphery of the face of the first electrode is coincident with the periphery of the foam tube, and the polymeric foam is electrically conductive in order to enhance the electrical conductivity of the novel connector. A polymeric foam is easily and economically made electrically conductive by loading it with electrically conductive carbon black.

When the foam of the tube is electrically conductive, the cavity formed in the tube need not be open at the base of the reservoir, because the conductive foam can complete the electrical connection between the gel and the first electrode.

Preferably only the cavity of the foam tube is initially filled with the electrically conductive gel and its polymeric foam is open-cell so that its cells can provide a haven for excess conductive gel which otherwise might be squeezed laterally through the garment fabric beyond the perimeter of the connector to become a source of contamination. Furthermore, conductive gel which is taken up by the foam can be squeezed through the fabric, thus enlarging the area of conductive gel in contact with the second electrode and providing better electrical conductivity through the fabric.

In the preferred prototype connector, each of said first and second parts is made of moldable plastic, both for economy and for lightness in weight. The second of said parts forms a hollow cylindrical shell, and the first of said parts is a disk formed with a projection containing said reservoir, which projection is received by said shell. The interior wall of said hollow shell is substantially cylindrical and is formed with a pair of detents about 180° apart, and the projection of the first part is formed with a pair of pawls which interlock with the detents when the two parts are rotated relative to each other to entrap a garment fabric. In order to minimize fraying of the garment during such rotation, the plastic may be nylon which both has a low coefficient of friction in contact with a garment fabric and is highly resistant to chafing.

In the preferred prototype, the aforementioned means for connecting said electrodes comprise a metal stud projecting from the face of each of the two plastic parts opposite to its fabric-contacting face. Each metal stud is formed to make a snap fit with a terminal on a wire leading from the wrist strap or ground. It may be preferred to solder a wire to the electrode of the first plastic part to make it easier to attach the novel removable connector to a wrist strap.

BRIEF DESCRIPTION OF THE DRAWINGS

A preferred prototype of the electrical connector of the invention is schematically illustrated in the drawings, of which.

DETAILED DESCRIPTION OF THE PREFERRED EMBODIMENTS

Figure 1:
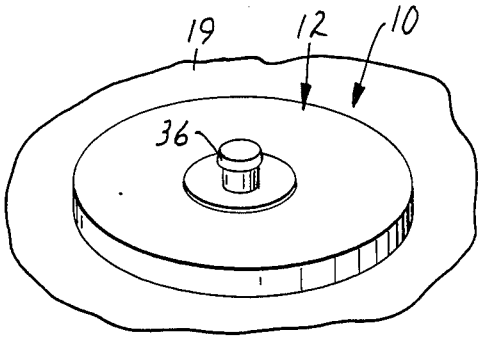
FIG. 1 is an isometric view of a portion of the sleeve of a garment to which the prototype is temporarily attached.

The prototype removable connector 10 of FIGS. 1–4 comprises first and second interconnectable plastic parts 12 and 14. The first plastic part 12 comprises a disk with a central projection 15 in which is formed a cylindrical, open reservoir 16. The exterior surface of the projection is substantially a right cylinder, and projecting therefrom are a pair of pawls 17 about 180° apart. The second plastic part 14 comprises a hollow shell having a substantially cylindrical inner wall from which project a pair or detents 18. The detents interlock with the pawls 17 when the projection 15 is inserted into the hollow shell and the two plastic parts 12 and 14 are rotated relative to each other to become interconnected to entrap a garment fabric 19, with the circular edge 20 of the reservoir 16 fitting flush against the fabric. The exterior surface of the second plastic part 14 is cylindrical except for two flats 21 which serve as finger holds.

Each of the first and second plastic parts 12 and 14 is formed at its periphery with a substantially flat fabric-contacting surface 22 and 24, respectively, between which surfaces the fabric 19 is compressed when the two plastic parts 12 and 14 are interconnected. Two rounded knobs 26, 28 positioned 180° apart along each of the fabric-contacting surfaces 22, 24, respectively, together act as rotational stops after the first and second plastic parts 12 and 14 have been rotated in either direction about 90° with respect to each other.

Formed in the outer wall and on the axis of each of the first and second plastic parts 12 and 14 is an opening at which first and second metal electrodes 32 and 34, respectively, are riveted to studs 36 and 38, respectively, each of which projects beyond the wall of the plastic part 12, 14 opposite to its fabric-contacting surface 22, 24, respectively. Each of the studs 36 and 38 is formed to make a snap fit with a terminal 39 and 40, respectively, the terminal 39 being connected by a wire to a wrist strap 42 while the terminal 40 is connected by another wire to a ground 44.

Figure 2:
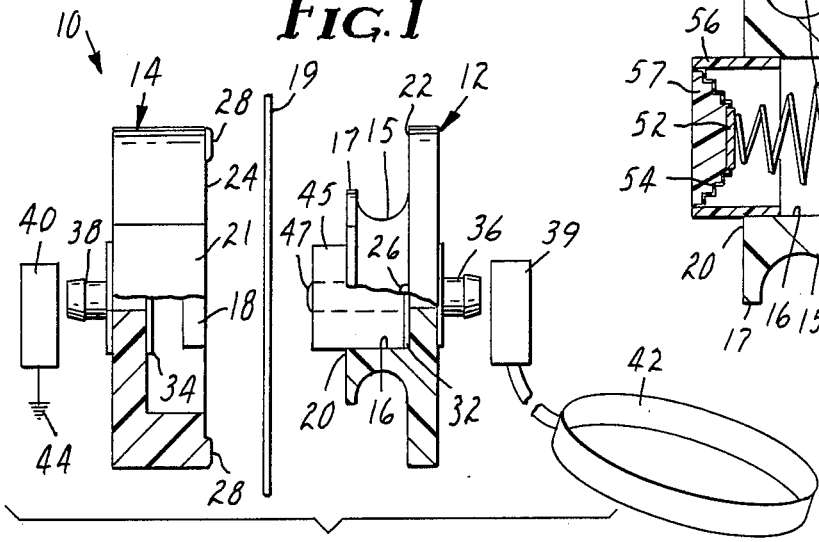
FIG. 2 is a side elevation of the prototype, partly cut away to a central section, and a tube of polymeric foam containing an electrically conductive gel, which tube has been inserted into a reservoir in one of the prototype's two plastic parts which are in position to be interconnected through the garment sleeve between a wrist strap and ground.

Shown in FIG. 2 is a cylindrical tube 45 of elastic, polymeric, electrically conductive, open-cell foam which is formed with a cavity that is open at both ends and filled with an electrically conductive gel 47. When the gel-filled open tube 45 is seated in the reservoir 16 as shown in FIG. 2, it and the conductive gel 47 rest against the flat face of the first metal electrode 32 at the bottom of the reservoir, and protrude a short distance beyond the circular edge 20 of the reservoir. When the garment fabric 19 is entrapped as shown in FIG. 1, the foam tube 45 is compressed by the flat face of the second metal electrode 34 and transmits a squeezing force against the conductive gel 47, thus forcing it to flow into the interstices of the fabric 19 and into contact with the second electrode 34. This forms an electrical path though the conductive gel 47 between the first and second electrodes 32, 34 and thus permits the wrist strap 42 to be electrically connected through the garment to the ground 44.

Figure 5:
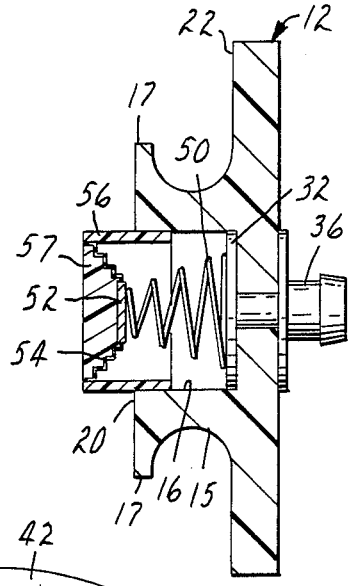
FIG. 5 is a cross section through the reservoir-containing plastic part of FIGS. 1–3, somewhat enlarged, which has been modified to permit the foam tube to be eliminated.
Figure 4:
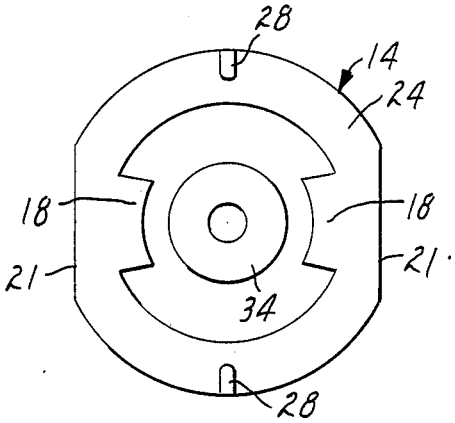
FIG. 4 is a front elevation of the other of the two plastic parts.
Figure 3:
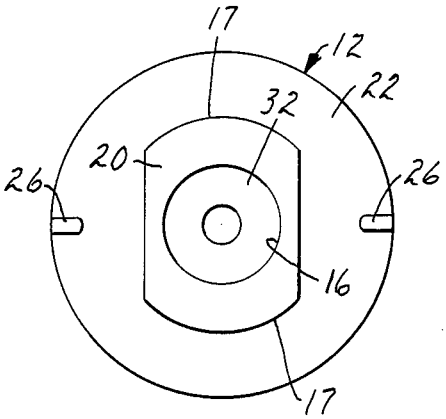
FIG. 3 is a front elevation of the reservoir-containing plastic part.

As shown in FIG. 5, the gel-filled tube 45 can be replaced by other means for squeezing the electrically conductive gel into an entrapped fabric. Soldered to the first electrode 32 is an electrically conductive metal coil spring 50, the other end of which is soldered to a disk-shaped electrically conductive metal plate 52. Adhesively bonded to the perimeter of the metal plate 52 is a flexible rubber cup 54 which is corrugated to be collapsible. The plate thus forms the base of the cup, the lip of which is adhesively bonded to one end of a plastic sleeve 56. The length of the coil spring 50 is selected so that with the plastic sleeve 56 slidably positioned in the reservoir 16, the cup 54 extends beyond the edge 20 of the reservoir, as illustrated in FIG. 5. The rubber cup 54 is filled with an electrically conductive gel 57. When the first plastic part 12, fitted as shown in FIG. 5, is connected to the second plastic part 14 to entrap a garment fabric, the plastic sleeve 56 is forced into the reservoir 16 by the flat face of the second metal electrode 34, thus compressing the coil spring 50 which transmits a squeezing force against the conductive gel 57. This forces the gel to flow through the fabric and into electrical contact with the second electrode 34, thus completing an electrical path between the two electrodes 32 and 34.

EXAMPLE

The prototype shown in the drawing has been constructed using "Delrin" acetal resin from E. I. duPont for the first and second plastic parts 12 and 14, because this plastic is easy to machine. Nylon would be preferred when the plastic parts are molded. The metal electrodes 32, 34 were stainless steel #304. The tube 45 was an open-cell polyurethane foam having a density of 3 lbs/ft$^3$ and filled with electrically conductive carbon black to provide an electrical resistivity of $1\times10^5$ ohm-cm.

An electrically conductive gel 47 was prepared as follows:

A mixture of 52 grams of ethylene glycol, 16 grams of glycerol, and 2 grams of methyl vinyl ether/maleic anhydride copolymer was heated to 85° C. with stirring until gelling had started. This temperature was maintained for 3 hours to provide a gel which then was allowed to cool to room temperature. The pH of the gel was about 6. Its electrical conductivity was surprisingly good in view of it being water-free and salt-free. By being water-free, there is no hazard of evaporation. The absence of salt avoids corrosion problems.

| Significant dimensions of the prototype were: | in inches | in cm |
|---|---|---|
| Outside diameters of plastic parts 12 and 14 | 1.120 | 2.87 |
| Spacing between fabric-contacting surfaces 22 and 24 when parts 12 and 14 are interlocked | .010 | 0.025 |
| Diameter of reservoir 16 | .400 | 1.02 |
| Depth of reservoir 16 | .200 | 0.51 |
| Height of rounded knobs 26, 28 | .025 | 0.064 |
| Circumferential thickness of knobs 26, 28 | .050 | 0.13 |
| Diameters of electrodes 32 and 34 | .4 | 1.0 |
| Height of uncompressed foam tube 45 | .375 | 0.96 |
| Inside diameter of foam tube 45 | .125 | 0.32 |

Using a syringe, the electrically conductive gel 47 was squirted into the cavity of the foam tube 45, and the filled tube was seated in the reservoir 16. The two plastic parts 12, 14 were then interconnected to entrap a piece of cleanroom garment fabric (polyester) which had a thickness of about 0.125 mm. The electrical resistance between the studs 36 and 38 was then measured to be 200,000 ohms. In order to bleed off static charges, the electrical resistance should be about one megohm or less.

When the garment fabric is polyester, the electrical resistivity reaches its ultimate value almost immediately. However, cleanroom garment fabrics which are less porous may require a short period of time to allow the electrically conductive gel to penetrate fully. When the cleanroom garment fabric is "Gore-tex", there is a delay of about 10 minutes before the desired electrical conductivity is achieved.

Some cleanroom garment fabrics are electrically conductive by virtue of a grid of electrically conductive fiber woven into the fabric. Because the spacing between adjacent conductive fibers of those fabrics is less than the diameters of the reservoir 16 of the prototype, such garments have inevitably been grounded through the electrically conductive gel of the prototype whenever it has been attached to one of those garments without any concern as to its positioning.

The prototype should be useful with cleanroom garment fabrics having thicknesses from about 0.01 to 0.015 inch (0.025 to 0.038 cm). Greater or lesser fabric thicknesses would call for correspondingly increased or decreased spacing between the fabric-contacting surfaces 22 and 24 when the plastic parts 12 and 14 are interlocked.

Because some of the conductive gel is lost when the prototype entraps fabric, a fresh foam tube and conductive gel should be used each time the removable connector is attached to a garment. Furthermore, it is necessary to remove the used foam tube and conductive gel in order to clean the connector between each use. The foam tube can be cut from a block but preferably is die-cut from a sheet, the thickness of which equals the desired axial length of the tube. By doing so, the cut edges of the foam tube are mainly within the reservoir, thus minimizing possible contamination from fragments generated during cutting.

Although the first plastic part 12 is of more economical manufacture when designed for a gel-filled foam tube 45 than when fitted as shown in FIG. 5, the latter may be more economical to use, requiring only gel refills.

While the illustrated prototype uses wire between the first electrode 32 and wrist strap 42, the stud 36 could be snapped directly onto a fitting of the wrist strap. However, a wire permits the wire to emerge anywhere from the garment, although it is assumed that most users will prefer to use a wire no longer than the length of the sleeve.

Each of the plastic parts 12, 14 could be entirely metal, but this would add to their cost and weight. Molded plastic parts are inexpensive and lightweight.

Another prototype of the novel connector employed screw threads to interconnect two plastic parts, but in use, the two parts had a tendency to work loose. When employing any such connector of the invention which includes means for preventing such loosening, care should be taken that such means do not chafe or fray the garment.

In a third prototype of the novel connector, the two interconnecting parts also comprised plastic, and the reservoir of the first plastic part was designed to be filled directly with an electrically conductive gel without using any plastic foam. In this prototype, the second electrode was formed to project into the reservoir to provide a squeezing force, but this force tended to make the two plastic parts work loose.

Numerous other variations in details of construction of the novel removable connector can be made within the ambit of the invention. For example, each of the two electrically insulative plastic parts of the removable connector could be formed with a reservoir to receive a foam tube filled with electrically conductive gel which would be forced into the entrapped fabric from both sides. In another variation, first and second plastic parts are formed as shown in the drawing except that the fabric-contacting surfaces 22 and 24 are shallowly inclined planes, thus eliminating the need for the rounded knobs 26 and 28, because rotation is stopped when the garment fabric cannot be further compressed by the force applied by the user's fingers.

Thus, there has been shown and described a novel electrical connector for electrically conducting through a fabric. It is to be recognized and understood, however, that various changes, modifications and improvements in the form and the details of the invention may be made by those skilled in the art without departing from the scope of the following claims.

What is claimed is:

1. An electrical connector useful for electrically connecting through a fabric comprising:

a first part and a second part adapted to be interconnected to entrap said fabic from both sides;

said first part and said second part when interconnected forming a reservoir therebetween;

a first electrode coupled to said first part electrically communicating with the interior of said reservoir, a second electrode coupled to said second part electrically communicating with the interior of said reservoir;

first interconnection means coupled to said first part for connecting said first electrode exterior of said reservoir on one side of said fabric; and second interconnection means coupled to said second part for connecting said second electrode exterior of said reservoir on the other side of said fabric;

whereby said first part and second part may be interconnected from opposite sides of said fabric and said reservoir may be filled with an electrically conductive gel capable of penetrating said fabric and thus an electrical connection be established through said fabric.

2. An electrical connector as in claim 1 which further comprises actuation means coupled to one of said first part and second part for forcing an electrically conductive gel through said fabric when said first part and said second part are interconnected entrapping said fabric.

3. An electrical connector as in claim 1 wherein said first part is formed with an edge which at least partially defines said reservoir, said edge being flush with said fabric when said fabric is entrapped between said first part and said second part.

4. An electrical connector as in claim 3 which further comprises a compressible foam material mounted to said first part in said reservoir extending beyond said edge before said first part and said second part are interconnected whereby an electrically conductive gel may be contained in said foam and forced through said fabric when said first part and said second part are interconnected.

5. An electrical connector as in claim 4 which further comprises an electrically conductive gel contained in said reservoir and contacting said first electrode, said second electrode and said foam material.

6. An electrical connector as in claim 5 wherein said reservoir has a cylindrical inner wall, and said foam material fits snugly within said cylindrical inner wall.

7. An electrical connector as in claim 4 wherein said foam material is open-cell.

8. An electrical connector as in claim 1 wherein said second part forms a hollow shell, and said first part is formed with a projection containing said reservoir, which projection is received by said hollow shell when said first part and said second part are interconnected.

9. An electrical connector as in claim 8 wherein the interior wall of said hollow shell is substantially cylindrical and is formed with a pair of detents about 180° apart, and said projection is formed with a pair of pawls which interlock with the detents when said first part and said second part are rotated relative to each other to entrap said fabric.

10. An electrical connector as in claim 9 wherein each of said first part and said second part is formed at its periphery with a substantially flat fabric-contacting surface, between which surfaces the fabric is compressed to form a seal when said first part and said second part are interconnected to entrap said fabric.

11. An electrical connector as in claim 10 wherein said fabric-contacting surface of said first part and said second part is formed with as least one knob that together act as a rotational stop.

12. An electrical connector as in claim 1 further comprising an electrically conductive metal plate electrically connected to said first electrode by an electrically conductive spring, said plate forming the base of a collapsible cup which normally extends beyond said edge and when said cup holds an electrically conductive gel, said spring is compressed upon interconnecting said first part and said second part and transmits a squeezing force against said electrically conductive gel, thus forcing said electrically conductive gel to flow through said fabric and into contact with said second electrode.

13. An electrical connector as in claim 1 wherein said first interconnection means and said second interconnection means comprises a metal stud projecting from the face of said first part and said second part opposite to its fabric-contacting face.

14. An electrical connector as in claim 13 wherein said first part and said second part each comprise a moldable plastic.

15. An electrical connector as in claim 14 wherein said moldable plastic is nylon.

16. An electrical connector as in claim 14 wherein formed on the axis of each of said first part and said second part is an opening at which said first and second electrodes are respectively riveted to said studs.

17. A removable connector useful for connecting a wrist strap through a garment fabric to ground, said connector comprising two parts adapted to be interconnected to entrap a garment fabric, a first of said parts being formed with a reservoir that is formed with an opening, the edge of which fits flush against the entrapped fabric, said first of said parts containing a first electrode that reaches the interior of the reservoir, a second of said parts containing a second electrode which is contacted by the entrapped fabric where it extends across said opening, an electrically conductive gel contained in said reservoir, means for connecting one of said electrodes to a wrist strap and the other to ground and, when the reservoir holds an electrically conductive gel, means actuated by interconnecting said two parts for squeezing the gel through the entrapped fabric and against the second electrode to complete an electrically conductive path between the electrodes through the gel.

18. Removable connector as defined in claim 17 wherein an open tube comprising elastic polymeric foam (a) is seated in said reservoir, (b) extends beyond the edge of said opening before the first and second parts are interconnected, and (c) is filled with an electrically conductive gel.

19. Removable connector as defined in claim 18 wherein said reservoir has a cylindrical inner wall, and said tube fits snugly within said wall.

20. Removable connector as defined in claim 18 wherein said foam is open-cell.

21. Removable connector as defined in claim 17 wherein the second of said two parts forms a hollow shell, and the first of said parts is formed with a projection containing said reservoir, which projection is received by said shell when the two parts are interconnected.

22. Removable connector as defined in claim 21 wherein the interior wall of said hollow shell is substantially cylindrical and is formed with a pair of detents about 180° apart, and said projection is formed with a pair of pawls which interlock with the detents when said first and second parts are rotated relative to each other to entrap a garment fabric.

23. Removable connector as defined in claim 22 wherein each of said first and second parts is formed at its periphery with a substantially flat fabric-contacting surface, between which surfaces the fabric is compressed to form a seal when the first and second parts are interconnected to entrap the fabric.

24. Removable connector as defined in claim 23 wherein the fabric-contacting surface of each of said first and second parts is formed with as least one knob that together act as a rotational stop.

25. Removable connector as defined in claim 17 and further comprising an electrically conductive metal plate electrically connected to the first electrode by an electrically conductive spring, said plate forming the base of a collapsible cup which normally extends beyond the edge of the reservoir, and when the cup holds an electrically conductive gel, the spring is compressed upon interconnecting said two parts and transmits a squeezing force against the gel, thus forcing the gel to flow through the fabric and into contact with the second electrode.

26. Removable connector as defined in claim 17 wherein said means for connecting said electrodes comprises a metal stud projecting from the face of each of said first and second parts opposite to its fabric-contacting face.

27. Removable connector as defined in claim 26 wherein each of said first and second parts comprises a moldable plastic.

28. Removable connector as defined in claim 27 wherein said moldable plastic is nylon.

29. Removable connector as defined in claim 27 wherein formed on the axis of each of the first and second plastic parts is an opening at which said first and second electrodes are respectively riveted to said studs.

30. Removable connector useful for connecting a wrist strap through a garment fabric to ground, said connector comprising a first plastic part comprising a disk with a central projection in which is formed a cylindrical, open reservoir, the exterior surface of the projection being substantially a right cylinder from which project a pair of pawls about 180° apart, a second plastic part comprising a hollow shell having a substantially cylindrical inner wall from which project a pair of detents, the detents interlocking with the pawls when the projection is inserted into the hollow shell and the two plastic parts are rotated relative to each other to entrap a garment fabric with the edge of the open reservoir fitting flush against the fabric, each of the two plastic parts being formed with a substantially flat fabric-contacting surface, between which surfaces the entrapped fabric is compressed, said fabric-contacting surface of each of the two plastic parts being formed with at least one rounded knob that coact as a rotational stop, a metal electrode mounted in an opening on the axis of each of the first and second plastic parts, each electrode having a flat face, the face of the first electrode extending across the bottom of said reservoir, and that of the second extending across the open end of said reservoir when the two plastic parts are interconnected, and each electrode being formed with a stud that projects beyond the wall of the plastic part opposite to its fabric-contacting surface, each of the studs being formed to make an electrical connection.

31. Removable connector as defined in claim 30 having seated in said reservoir a tube of elastic, electrically conductive, polymeric, open-cell foam which is formed with a cavity that is open at both ends and filled with an electrically conductive gel.

32. Removable connector as defined in claim 31 wherein said foam tube when seated in said reservoir extends beyond the edge of the opening of the reservoir before the two plastic parts are interconnected.

* * * * *

UNITED STATES PATENT AND TRADEMARK OFFICE

CERTIFICATE OF CORRECTION

PATENT NO. : 4,762,497

DATED : August 9, 1988

INVENTOR(S) : Richard W. Burvee

It is certified that error appears in the above-identified patent and that said Letters Patent is hereby corrected as shown below:

Col. 4, line 16, "though" should read --through--.

Col. 7, line 51, "as" should read --at--.

Col. 8, line 65, "as" should read --at--.

Signed and Sealed this

Fourth Day of July, 1989

*Attest:*

*Attesting Officer*

DONALD J. QUIGG

*Commissioner of Patents and Trademarks*